United States Patent [19]

Hendriks

[11] Patent Number: 4,629,263

[45] Date of Patent: Dec. 16, 1986

[54] CABINET DRAWER BAR RETAINING MECHANISM

[76] Inventor: John G. Hendriks, 608 Martha, Decatur, Ala. 35601

[21] Appl. No.: 657,646

[22] Filed: Oct. 4, 1984

[51] Int. Cl.[4] ..... E05B 65/46

[52] U.S. Cl. ..... 312/216; 211/4

[58] Field of Search ..... 312/216, 348, 215, 333; 292/259 R; 211/4, 129

[56] References Cited

U.S. PATENT DOCUMENTS

| | | | |
|---|---|---|---|
| 1,695,896 | 12/1928 | Holden | 312/216 |
| 3,902,603 | 9/1975 | Wilson | 312/216 |
| 4,067,444 | 1/1978 | Wilson | 312/216 |
| 4,465,329 | 8/1984 | Haas et al. | 312/216 |

*Primary Examiner*—Kenneth J. Dorner
*Assistant Examiner*—Joseph Falk
*Attorney, Agent, or Firm*—Freddie M. Bush; Harold W. Hilton

[57] ABSTRACT

A locking device for retaining a plurality of drawers in secured relation in a cabinet even while the cabinet is being transported and subjected to extreme vibrations. The device includes a rod carried in openings provided in upper and lower support brackets secured, respectively, to upper and lower surfaces of the cabinet. The rod is movable into and out of engagement with the drawers while remaining in the support bracket. The rod is provided with protrusions in the form of roll pins for retention of the rods in the brackets. The brackets are provided with grooves adjacent the openings to permit insertion of the protrusions on the rod therethrough. The roll pins extend beyond the openings in the brackets and are disposed for engagement with the lower surfaces thereof to prevent the rod from coming out of the brackets even under extreme vibrations.

5 Claims, 5 Drawing Figures

CABINET DRAWER BAR RETAINING MECHANISM

DEDICATORY CLAUSE

The invention described herein may be manufactured, used, and licensed by or for the Government for governmental purposes without the payment to me of any royalties thereon.

BACKGROUND OF THE INVENTION

Some missile systems require the use of vans which must accompany the missile in the field. Some of these vans carry material such as repair parts and test equipment which are necesary to the successful operation of the missile. Storage means must be provided in the vans for safely storing the material. The storage means typically is in the form of cabinets having a plurality of drawers therein which must be tightly secured against accidental opening while the vans are subjected to extreme vibrations as they travel over rough terrain with the missile as the missile is positioned in the field.

Typically, cabinets are manufactured with built-in latches for securing the drawers in secured relation. However such latches may not be capable of securing the drawers when the cabinets are subjected to extreme vibrations such as encountered when the cabinets are mounted in vans and moved over rough terrain. In the past, the drawers have been additionally secured by various type of locking devices including barn door type of locking devices (hasps and staple) or the like. Usually such type of locking devices include a separate padlock or pin for attachment to each individual drawer for secured relation thereof to the cabinet. Each individual locking device must include a loosely carried pin or padlock.

It is an object of the present invention, therefore, to provide a locking device which is self storing.

It is a further object of the present invention to provide such a locking device which will maintain drawers in secured relation in cabinets while the cabinets are subjected to extreme vibrations.

A locking device for retaining a plurality of drawers in secured relation in a cabinet even while the cabinet is subjected to extreme vibrations. The device includes a rod which extends the height of the cabinet and is supported by a pair of brackets or support members secured to the upper and lower front surfaces of the cabinet. The rod is movable in one direction in a pair of circular openings in the support members, for engagement with each drawer of the cabinet and for release of the drawers subsequent to movement of the rod in a second direction. The rod is provided with locking members which secure the rod in the brackets. The brackets include slotted openings which permit the rods to be inserted through the brackets for secured relation therein.

DESCRIPTION OF THE PREFERRED EMBODIMENT

Figure 1:
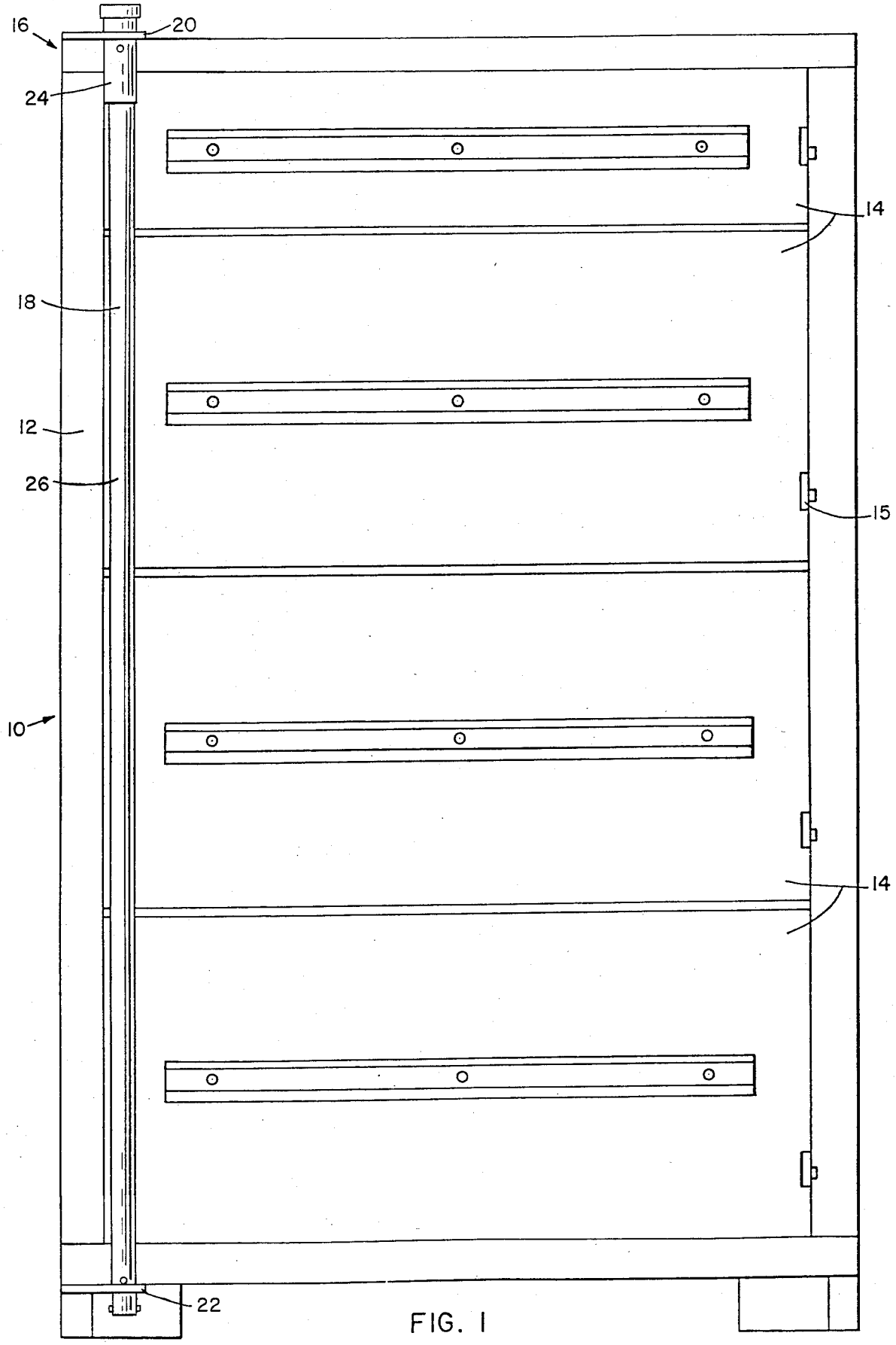
FIG. 1 is an elevational view of a cabinet having the locking device of the present invention in position for retaining the cabinet drawers thereof in secured relation.

As seen in FIG. 1 a cabinet 10 includes a frame 12 having a plurality of drawers 14 slidably carried therein. Typically the drawers are retained in the frame by latching devices illustrated at 15. However, such devices have proven incapable of securing the drawers in the frame when the cabinets are subjected to vibrations. A second locking mechanism 16, therefore, is provided for releasably securing the drawers 14 in frame 12 under these conditions.

Figure 2:
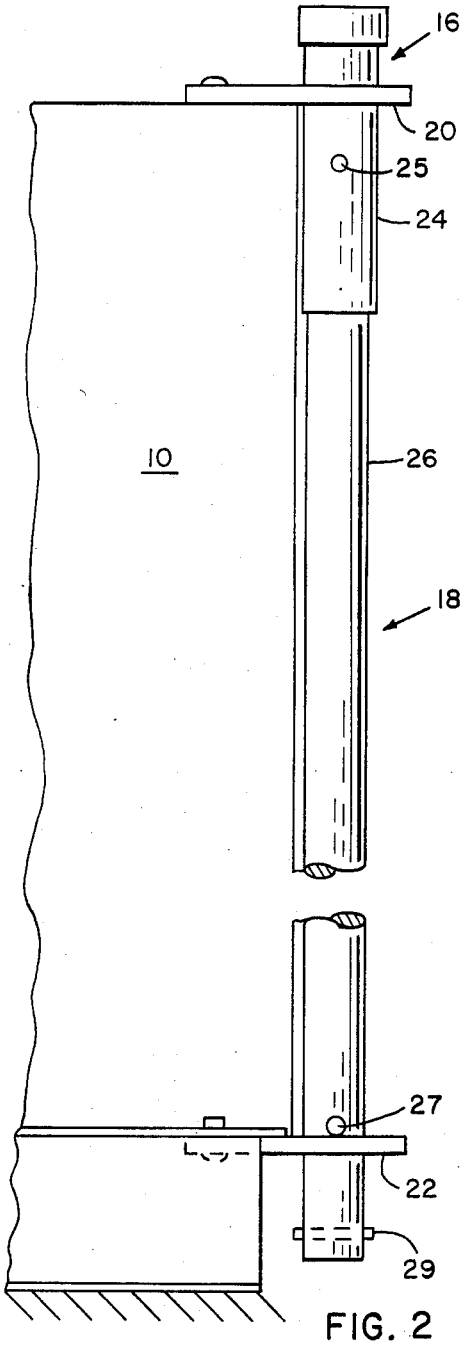
FIG. 2 is a side elevational view showing the rod in secured position.

Locking mechanism 16 includes a rod 18 supported on cabinet 10 by upper and lower brackets or support members 20 and 22, respectively. The support members 20 and 22 may be secured to the cabinet by bolts or by welding. Upper section 24 is provided with a roll pin 25 extending therethrough for positioning below member 20 subsequent to insertion of the rod through the brackets. Lower section 26 is provided with a pair of roll pins 27 and 29. As seen in FIG. 2, roll pin 27 is above support bracket 22 and roll pin 29 is below plate 22.

FIG. 2 is a side elevational view of the cabinet and rod assembly. As more clearly illustrated in FIG. 2 the rod is provided with upper and lower sections 24 and 26, respectively. Upper section 24 is of a larger diameter than lower section 26 and the upper end protrudes through upper support member 20 while the lower end protrudes through lower support member 22.

Figure 3:
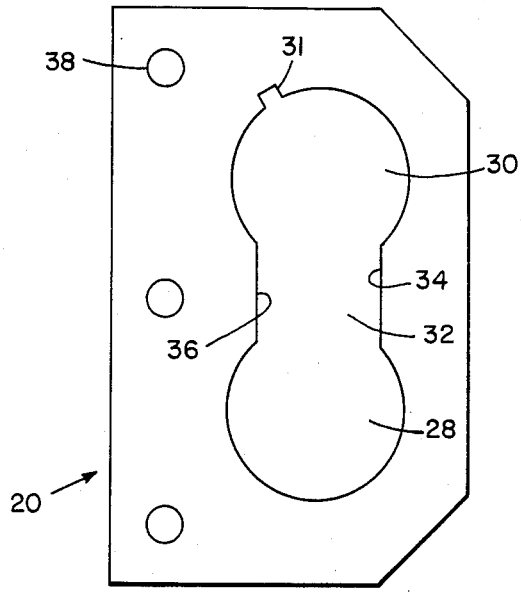
FIG. 3 is a plan view of the upper bracket of the locking device of the present invention.

As seen in FIG. 3 the upper support member includes a pair of substantially semi-circular joined openings 28 and 30. An opening or slot 32 is defined by a pair of spaced flat surfaces 34 and 36 which join openings 28 and 30. Slot 32 is smaller than the diameter of openings 28 and 30 and larger than the diameter of lower section 26 of the rod. A plurality of additional small openings 38 is provided for bolting support member 20 to the cabinet. The support member 20 is provided with a groove 31 adjacent opening 30.

Figure 4:
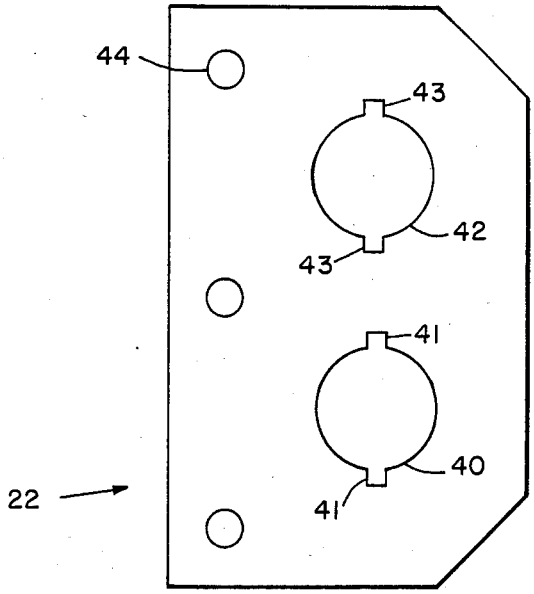
FIG. 4 is a plan view of the lower bracket of the locking device of the present invention.

As seen in FIG. 4, lower support member 22 includes a pair of spaced openings 40 and 42. Openings 40 and 42 are of smaller diameter than openings 28 and 30 of upper support bracket 20. A plurality of additional small openings 44 is provided for bolting support member 22 to the bottom side of the cabinet. Support member 22 is provided with pair of grooves 41 and 43, respectively adjacent openings 40 and 42.

Figure 5:
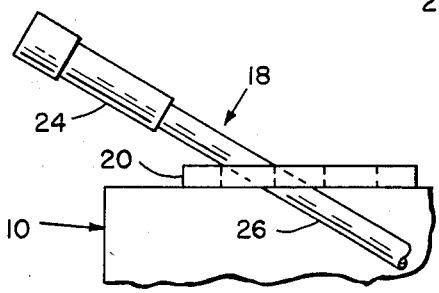
FIG. 5 is a diagrammatic illustration of the manner in which the rod is inserted in the brackets in a van having a low ceiling.

FIG. 5 is an illustration of the manner in which the rod may be inserted in the brackets in a van having a low ceiling. Rod 18 is tilted as shown for insertion into the upper bracket 20. Since the diameter of the lower portion of the rod is smaller than the openings 28 and 30 and connecting slot 32 of upper bracket 20, the rod may be inserted at a substantially steep angle. The rod is then slid through bracket 20 until the upper larger diameter portion 24 cannot be inserted through slot 32 since it is of a larger diameter than slot 32. The rod is then vertically aligned with an opening of the lower bracket and the lower end inserted therein. The rod must be rotated to a position where the pins may pass through slot 31 of bracket 20 and slots 41 and 43 of bracket 22. After the rod has been inserted through the openings in the bracket, the rod is rotated so that the pins are out of alignment with the slots. To retain the rod in stored position (with the drawers unsecured) the rod is positioned in openings 28 and 40 of brackets 20 and 22, respectively. To position the rod for securing the drawers in locked position it is merely raised so that the lower surface of the larger diameter portion is clear of bracket 20 and since the diameter of the lower portion of the rod is smaller than slot 32, the rod may be slid through the slot and into opening 30. The rod is then aligned with opening 42 of bracket 22 and inserted therein. Pin 27 is shown in FIG. 2 to be in engagement with the upper surface of bracket 22. This retains the rod in the position shown in FIG. 2.

The rod need not be machined to close tolerances as would be necessary to provide for a snug fitting engagement in the brackets since the pins extend beyond the openings in the bracket and prevent the rod from coming out of the brackets even under very severe vibrations. Also it should be noted that pins 25 and 29 are not in alignment with each other (displaced by 90°) and that the spacing between the pins are such that after pin 29 is inserted through the grooves of the lower bracket the rod may be rotated for pin 25 to pass through the groove in the upper bracket and the rod is inserted through the bracket until pin 27 engages support bracket 22.

I claim:

1. A locking device for releasably securing a plurality of drawers in a cabinet, said locking device comprising:

a. a pair of upper and lower support brackets respectively secured to upper and lower surfaces of said cabinet, said upper support bracket having a pair of semi-circular openings therein joined by a connecting slot having a width smaller than the diameters of said semi-circular openings, said upper bracket having a groove adjacent one of said semi-circular openings, said lower bracket having a pair of spaced openings therein and each said opening having a groove adjacent thereto;

b. a rod supported in said brackets, said rod disposed for engagement with said drawers for retention thereof in secured relation, said rod being positioned in a first of said semi-circular openings of said upper bracket and a first of said pair of openings of said lower bracket for secured relation of said drawers and movable to a second of said semi-circular openings of said upper bracket and the second of said pair of spaced openings of said lower bracket for release of said drawers, said rod having a first protrusion adjacent an upper end of an upper section and a second protrusion adjacent a lower end of a lower smaller diameter section, said rod disposed for movement of said lower smaller diameter section through said connecting slot joining said semi-circular openings for emplacement of said rod in a desired semi-circular opening, said first protrusion being positioned below said upper bracket and said second protrusion being positioned below said lower bracket after insertion of said rod in said brackets to prevent said rod from being moved out of said brackets even under severe vibrations.

2. A locking device as in claim 1 wherein said upper section of said rod is provided with a diameter larger than the diameter of said lower section.

3. A locking device as set forth in claim 2 wherein said openings of said lower bracket are of a smaller diameter than said openings of said upper bracket.

4. A locking device as in claim 3 wherein said protrusions are roll pins extending through said rod.

5. A locking device as in claim 4 including a third roll pin extending through said rod for engagement with the upper surface of said lower bracket for retaining said rod in said brackets in a predetermined position.

* * * * *